United States Patent [19]

Worrall et al.

[11] 4,243,713

[45] Jan. 6, 1981

[54] WOVEN FABRIC HAVING A TEXTURED, MULTICOLOR APPEARANCE, AND METHOD OF PRODUCING SAME

[75] Inventors: James D. Worrall, East Greenwich; Suzanne M. Auger, Coventry, both of R.I.

[73] Assignee: Engineered Yarns, Inc., Coventry, R.I.

[21] Appl. No.: 957,368

[22] Filed: Nov. 3, 1978

[51] Int. Cl.[3] ..... B32B 7/00; D02G 3/00

[52] U.S. Cl. ..... 428/245; 156/78; 156/148; 428/288; 428/874; 428/375; 428/394; 428/395

[58] Field of Search ..... 428/245, 265, 259, 255, 428/257, 365, 288, 296, 295, 373, 374, 375, 378, 394, 395; 156/148, 229, 78; 427/434, 407 R, 412; 139/408, 413, 416, 417, 418, 420 R

[56] References Cited

U.S. PATENT DOCUMENTS

| | | | |
|---|---|---|---|
| 3,100,926 | 8/1963 | Richmond | 156/148 |
| 3,210,446 | 10/1965 | Yamakawa et al. | 428/295 X |
| 3,434,510 | 3/1969 | Neyret | 139/413 |
| 3,462,523 | 8/1969 | Marzocchi et al. | 427/434 D X |
| 3,761,346 | 9/1973 | Caroselli et al. | 428/152 |
| 4,144,371 | 3/1979 | Okie et al. | 428/255 |

*Primary Examiner*—Lorraine T. Kendell
*Attorney, Agent, or Firm*—Fleit & Jacobson

[57] ABSTRACT

A woven fabric having a textured, multicolor appearance is disclosed. The fabric is formed from a weave of expansible threads, wherein each thread comprises a core yarn, a first plastisol coating surrounding the core yarn, and a second plastisol coating surrounding the first coating and eccentric thereto. The first and second coatings are of different colors. The expansible threads are woven into a substantially planar fabric and then fused by heat activation. At the fusion temperature, the melt viscosity of the second coating is sufficiently high so that the first coating emerges through the second coating at the thin areas of the second coating. Preferably, the first coating has a substantially greater amount of blowing, or foaming, agent than the second coating so that the first coating expands to a greater degree than does the second coating.

35 Claims, 7 Drawing Figures

FIG. 1
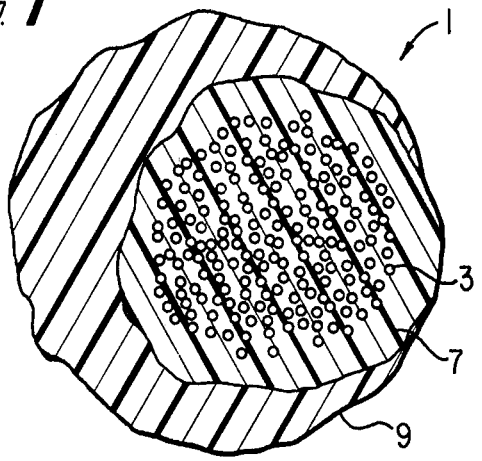
FIG. 2(a)
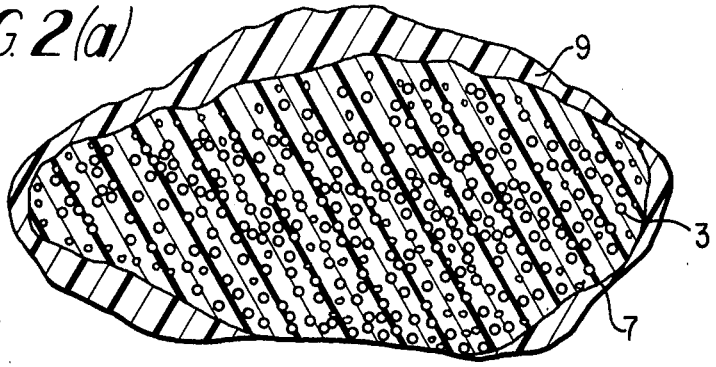
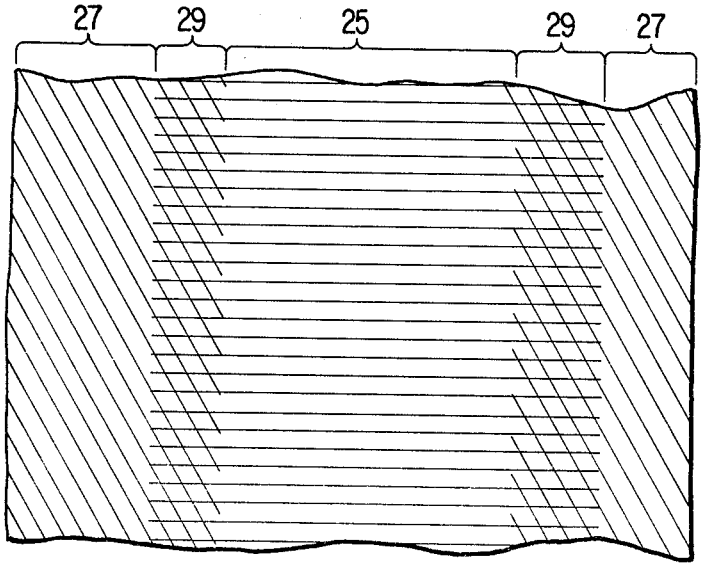
FIG. 2(b)

FIG. 3(a)
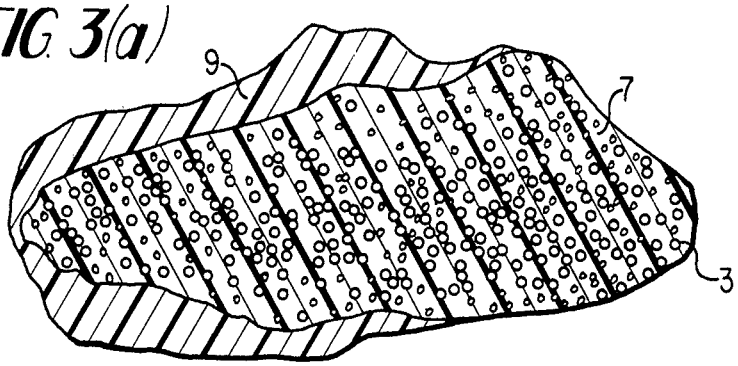
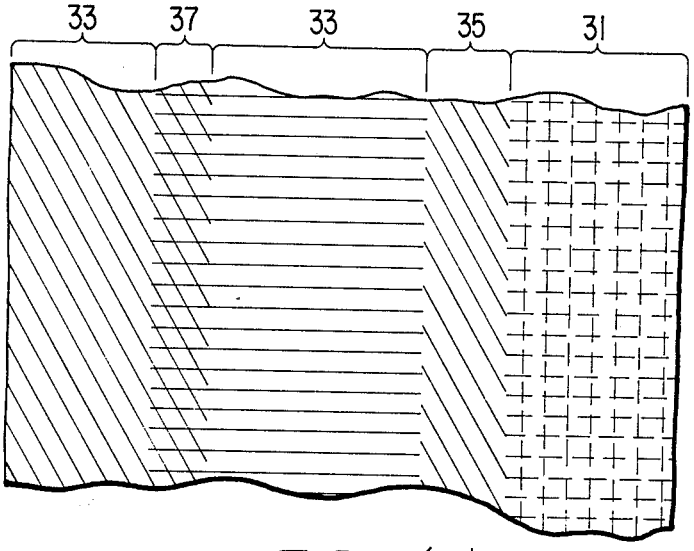
FIG. 3(b)
FIG. 4
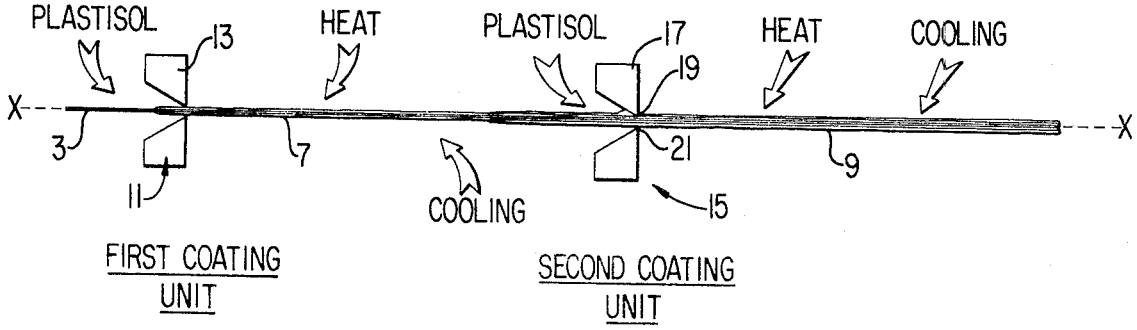

WOVEN FABRIC HAVING A TEXTURED, MULTICOLOR APPEARANCE, AND METHOD OF PRODUCING SAME

BACKGROUND OF THE INVENTION

The present invention relates to fabrics having a textured, multicolor, appearance, woven from expansible threads having at least two coatings, or layers, of different colors, wherein each coating is eccentric with the prior coating or coatings. During heat activated foaming of the woven fabric, the first and second coatings expand at different rates depending upon their relative melt viscosities and blowing agent percentages, to produce a textured multicolor fabric.

Fabrics woven from vinyl coated yarns are well known in the art. Such fabrics have the attributes of open mesh construction allowing breathability and drainage, protection of yarn filaments from fiber/fiber abrasion at weave crossover points, and multicolor random, plaid or tweed effects achieved without subsequent overprinting operations. In general, vinyl coated yarns can be manufactured either by extrusion coating, or by plastisol dip coating, also referred to as a dip/die coating.

The extrusion coating process is discussed in great detail in U.S. Pat. No. 3,100,926 (Method of Producing Expanded Fabric-Like Material—E. B. Richmond). As discussed in that patent, the extrusion coating operation utilizes a crosshead extruder, much like wire coating, wherein a multifilament strand, such as polyester, nylon, rayon or glass is encapsulated with melted vinyl in the crosshead using a pressure or tubing die and then cooled in a water bath. There is virtually no penetration of vinyl among the yarn filaments due to the relatively high viscosity of the liquid vinyl.

In the plastisol dip coating process, as disclosed in copending U.S. Patent Application Ser. No. 744,018, filed on Nov. 22, 1976, now U.S. Pat. No. 4,144,371 (Flattened and Bonded Fabric of Foamed Vinyl Plastisol on a Filament Core and Method of Preparing Same—Okie et al), hereafter referred to as the Okie et al application, incorporated by reference herein, a multifilament strand, such as polyester, nylon, rayon or glass, is immersed in a liquid vinyl plastisol, and the excess coating is wiped off by passing through a suitable orifice, such as a wire drawing, or sizing, die, to properly size the yarn. The strand is then passed through a heated oven to at least partially cure, or solidify, the coating. In this case, there will be a considerable amount of impregnation or penetration of the filament bundle by the vinyl, depending on the yarn twist and the viscosity temperature relationship of the plastisol. The impregnation or penetration is referred to as "wet-out".

A further modification can be made to yarns produced by extrusion coating and plastisol dip coating by incorporating a thermally activated chemical blowing agent in the vinyl formulation which remains latent during coating and curing, but which, after the coated yarns are woven into fabric and heat-finished, decomposes at fabric finishing temperatures to yield an expanded cellular structure in the vinyl. One such blowing agent is azodicarbonamide, which decomposes between 302° and 392° F. The technology of yarns with latent foaming characteristics is described in the aforementioned U.S. Pat. No. 3,100,926 for extruded yarns, and in the aforementioned Okie et al application for plastisol dip yarns. As pointed out in the Okie et al application, the latent foam feature allows the yarn produced by the plastisol dip process to undergo significant flattening during finishing due to the expanding vinyl being present among the filaments as previously described. In contrast, a yarn produced by the plastisol dip process, which does not contain a latent chemical blowing agent, has a finished width in a typical fabric of about half that containing a blowing agent.

In fabrics woven from these types of yarns, it is further known to improve styling by utilizing a number of colors or patterns including solid colored stripes as described in copending U.S. Patent Application Ser. No. 939,705, filed on Sept. 5, 1978 (Fabric Having Multiple Solid Colored Stripes—Worrall), hereafter, the Worrall application, incorporated herein by reference. A stripe effect can be introduced into the fabric by alternating groups of warp or filling yarns. By using a clear vinyl coated yarn without a foam structure as a filling yarn, the solid stripe effect is closely approximated, especially if the filling yarn utilizes a polyester core fiber.

SUMMARY OF THE INVENTION

The present invention relates to the production of a fabric that is woven from vinyl coated yarns to produce an enhanced textured and multicolor fabric effect. The fabric of the present invention is woven from expansible threads having two or more coats, or layers, of different colored plastisols with the second coat (and subsequent coats, if desired) oriented eccentrically to the prior coat when viewed in cross section across the yarn diameter. Different levels of chemical blowing agent can be contained in each coating which, when the yarn is finally foamed after weaving into a fabric by heat-finishing, results in each colored coating layer expanding to a different density proportional to the amount of blowing agent contained therein. The first and second coatings, or layers, are applied to a multifilament yarn by the method as described in the Okie et al application, to form expansible threads. A fabric is then woven from these expansible threads, and fused at a heat activation fusion temperature. The first coat will burst through portions of the second coat as a result of its different expansion characteristics, to provide a textured, three-dimensional appearing, multicolor effect.

Is is an object of the present invention to provide an expansible thread, and a method for manufacturing such expansible thread, having at least two layers wherein the second layer is eccentric with respect to the first layer. It is further an object of the present invention to provide a fabric, and a method for manufacturing such fabric, that is woven from such expansible threads, to produce a textured, three-dimensional appearing, multicolor fabric.

It is a further object of the present invention to provide the second coating of the expansible thread with less blowing, or foaming, agent than the first coating so that the first coating expands more than the second coating during heat activated foaming. Still further, it is an object of the invention to provide the second coating with a sufficiently high melt viscosity during the heat activated foaming of the fabric to ensure that the second coating does not lose its eccentricity with respect to the first coat, and thus completely and uniformly surround the first coat during foaming, thus masking the color of the first coat.

These and other objects and advantages of the invention will become further apparent when reference is made to the accompanying drawings and detailed description thereof.

BRIEF DESCRIPTION OF THE DRAWINGS

FIG. 1 is a cross section along the diameter of an expansible thread having two coatings prior to foaming.

FIGS. 2(*a*) and 2(*b*) are cross section and plan views, respectively, of a thread woven in a fabric in accordance with the present invention, after foaming.

FIGS. 3(*a*) and 3(*b*) are cross section and plan views, respectively, of an expansible thread woven in a fabric and having a different orientation from that of FIG. 2, after foaming.

FIG. 4 is a schematic diagram of the method of making an expansible thread of the present invention.

DETAILED DESCRIPTION OF THE DRAWINGS

Figure 5:
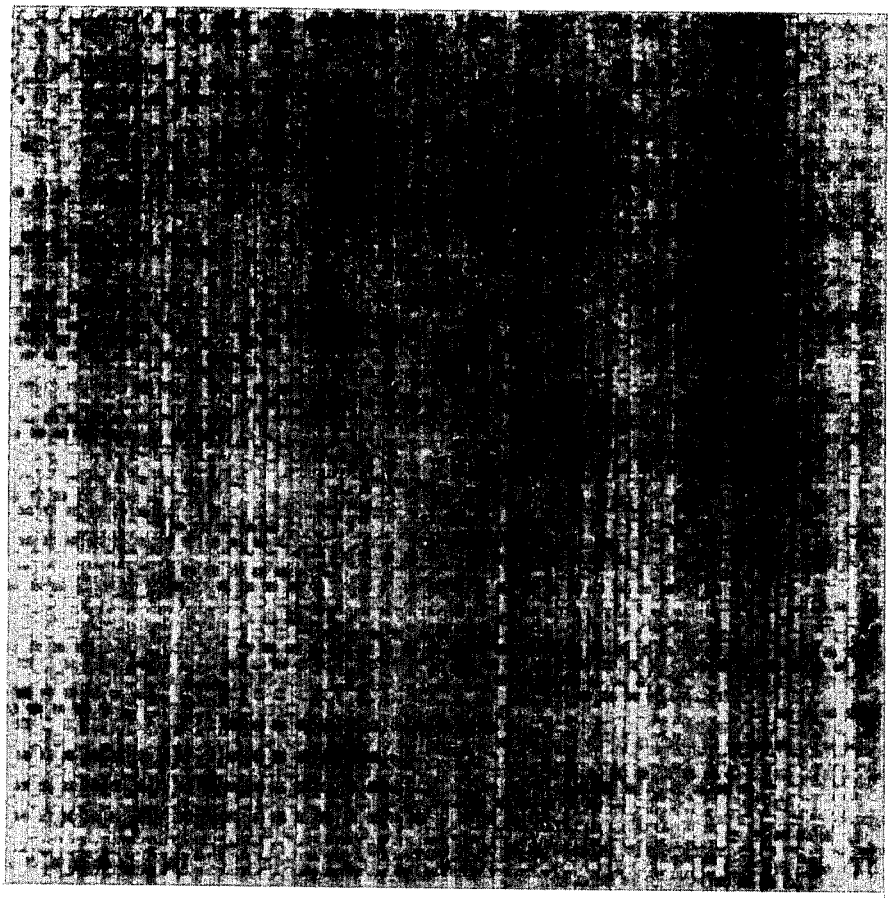
FIG. 5 represents a finished fabric according to the present invention.

The expansible thread 1 of the present invention comprises a multifilament yarn core 3. The filaments of the core are preferably polyester, but could also be nylon, rayon or glass. Preferably, the core 3 is a zero-twist core so that during heat activated foaming, the thread will flatten to the maximum extent.

Encapsulating and impregnating the multifilament core 3 is a first coating 7, and a second coating 9 of plastisol, preferably a latent foam vinyl plastisol, as is disclosed in the Okie et al application incorporated herein by reference. Plastisol is defined as a dispersion of very fine particle size PVC in plasticizers. The coatings 7, 9 are of different colors and are eccentric with respect to each other. Further coatings can be provided, wherein each further coating is eccentric with respect to the prior coatings.

The first and second coatings 7,9 are applied as a viscous liquid using the dip/die method described in the Okie et al application. In this regard, and referring to FIG. 4, a first coating unit 11 is schematically shown wherein a plastisol compound is applied, by dipping, to the yarn 3, wherein the yarn 3 then passes through a sizing die 13 to obtain the desired coating diameter, and wherein the first coating is partially fused, or cured, by heat, without expansion, to the point where it can withstand the stresses of subsequent processing. Curing is accomplished by the addition of heat, at a sufficiently low temperature to avoid activation of the foaming agent. The yarn 3, encapsulated with a first coating 7, is then forwarded to a second coating unit 15 and the second plastisol compound, of a different color than the first coating, is applied, by dipping. The second coating is applied using the method of Okie et al, but modified to ensure that the second coating 9 is eccentric to the first coating 7.

The eccentric second coating can be achieved by aligning the longitudinal axis X—X of the yarn in the second coating unit 15 with respect to the sizing die 17 such that the yarn is directed as closely as possible to one side 19 of the sizing die 17. This off-set alignment will enable one side 19 of the sizing die to scrape off, or remove more of the plastisol compound than does the other side 21 of the sizing die 17.

As will be recognized by one of ordinary skill in the art, the room temperature viscosity of the second plastisol coating 9, during the dipping of the first coated yarn 7 into the second plastisol compound, must be sufficiently high so that a sufficient amount of plastisol will be applied to the yarn without dripping off the yarn. Moreover, the room temperature viscosity must be sufficiently high so that the second coating 9 does not tend to flow uniformly, or concentrically, around the first coating 7. Likewise, it should be recognized that the room temperature viscosity of the second coating 9, at the point where it passes through the sizing die 15, must not be so great that the shear forces generated by the plastisol wetted yarn 1 against the side 19 of the sizing die 17 cause the yarn to center itself in the sizing die orifice, which would likewise result in a more concentric deposition of the second coating. The technique for providing the correct room temperature viscosity in order to satisfy the above requirements is readily known to one of ordinary skill in the art.

Following the application of the second coating 9, the thread 1 is partially cured by heating and cooling, as described in Okie et al, to the point where it can withstand the stresses of subsequent processing.

The expansible thread 1 can be formed into a substantially planar fabric 23 (FIG. 5) by weaving a plurality of such threads in a manner as described in Okie et al. The woven fabric is then finished by heat-activated fusion, as described in Okie et al. The heat finishing of the fabric expands the woven threads into a foam structure, and causes the yarns to flatten. Heat finishing can occur at temperatures ranging from about 375° F. to about 410° F., preferably on a tenter frame, as described in the Okie et al application. During such fusion, it is important that the second coating 9 does not expand uniformly, or concentricly, around the first coating 7 to completely and uniformly enclose the first coating 7. That is, if the second coating 9 becomes too "thin" at the fusion temperature, it will tend to melt, or flow, around the first coating, thus preventing the first coating from showing through the second coating, and minimizing the desired multicolor effect. Thus, the melt viscosity of the second coating 9, at the fusion temperature, must be sufficiently high to prevent the second coating 9 from expanding in a concentric and uniform manner over the first coating 7. Preferably, the melt viscosity of the second coating 9 is greater than the melt viscosity of the first coating 7. As is known to those skilled in the vinyl plastisol art, the melt viscosity difference between the first and second coatings can be formulated by using, in conjunction with a low or zero level of blowing agent in the second coating, a lower plasticizer level, plasticizers of different efficiencies, high oil absorption fillers, or different molecular weight or types of resins. By formulating the second coating 9 so that its melt viscosity is considerably higher than that of the first coating 7 during heat activated foaming, the first, or inner, coating 7 preferably expands in the direction of the thin sections of the second coating. As these thin sections are randomly oriented on the face of the fabric 23 after weaving, an enhanced three-dimensional appearing textured effect is obtained during heat finishing of the fabric when the inner coating 7 foams. The primary tendency is for the expanding inner coating 7 to flatten the zero-twist core yarn 3, in a manner to be described, but when flattening is completed, any residual expanding vinyl pushes itself and/or the outer coating 9 toward the surface.

It has been found that by incorporating substantially more blowing agent in the first coating 7 than in the second coating 9, an enhanced multicolor effect can be achieved. A greater blowing agent percentage results in greater expansion; thus, the first coating 7 will burst through, and contribute, to the ultimate fabric color to a much greater degree than if equal quantities of blowing agent are in both coatings. If equal amounts of blowing agent are present in both coatings, the basic hue of the first coating is largely lost, because it is masked by the second coating. Thus, if white or very light first coatings are used, different levels of blowing agents are required. The function of chemical blowing agents, such as the Kempore 125 (azodicarbonamide) manufactured by Stepan Chemical Co., is described in the Okie et al application. Generally, the second coating has no more than 0.2% to 0.5% blowing agent. Successful results have been achieved with the first coating having a 4% blowing agent, with the second coating having a 0.4% blowing agent. Likewise, the first coating can have a 10% blowing agent, whereas the second coating can have no blowing agent.

FIGS. 2 and 3 depict cross sections and plan views of an expansible thread made in accordance with the present invention after foaming has occurred, i.e., after the threads 1 have been woven into a fabric, such as 23, and the fabric is foamed. Referring to FIG. 2, the second coat is blue, and the first coat is yellow. After weaving and foaming, the thread has a predominantly blue shade in its central section 25 and green shades where the yellow shows through the blue at the two edge portions 27. A combined blue-green effect 29 is achieved between the central and two end portions.

Referring to FIG. 3, FIG. 3(*a*) shows a thread, in cross section, wherein the thread has expanded in a different manner than in FIG. 2, due to the different orientation of the thread in the fabric. Looking at the plan view of FIG. 3(*b*), a more varied spectrum of colors is obtained, ranging from yellow at one edge 31 where the first coating 7 has burst through the second coating 9, to blue, at regions 33 where the second coating 9 remains relatively thick, to a green 35 or blue-green 37 effect where the second coating 9 is relatively thin so that both the yellow and blue coatings combine. When the expansible threads made in accordance with the present invention are woven into a fabric, the threads are oriented in the fabric somewhat randomly. During foaming, adjacent threads will expand and interfere with each other, thus causing the threads to expand in different directions, depending on their orientation. For example, if the thin area of the second coating 9 is in contact with an adjacent thread in the fabric, then during foaming, the first coating 7 may be unable to burst through that thin area to the same extent as if the thin area were not interfered with. This explains the different expansion characteristics between FIG. 2 and FIG. 3. In FIG. 2, the first coating 7 is unable to expand through the second coating 9 as much as is shown in FIG. 3. In addition, variations in the above-described coating process, to some extent effect the ultimate expansion characteristics.

FIG. 5 is a photolithograph of a finished foam fabric having a first coating of a white color, and a second coating of a beige color. The first coating has 4% blowing agent, and the second coating has 0.4% blowing agent. Because of this differential foaming in the first and second coats, the first coat color is able to contribute to the overall color effect.

It should be apparent that a wide color range of textured fabrics can be made by varying the different color combinations, and their relative opacities. The second, or outer, coating can be more translucent than the inner coating, so that the inner coating can show through the outer coating.

Another advantage of fabrics woven from the expansible threads 1 of the present invention is that a two-sided fabric results with respect to overall color appearance. When yarns are coated in the manner as described above, there is a slight differential in the coefficient of friction from one side of the yarn to the other side, along the length of the yarn. This is due primarily to the second coating 9 having a lower degree of fusion since it has been exposed to heat in only one oven, whereas the first coating 7 has been exposed to heat in two ovens, during the partial curing of the expansible thread. In the semi-cured, or semi-fused, state, there is a greater tendency for minute quantities of plasticizers to migrate to the surface when subjected to frictional forces, in effect, "squeezing" the unbound plasticizers out of the semi-fused resin matrix. These plasticizers act as a lubricant to lower the coefficient of friction. During weaving, the yarns tend to orient themselves so that the last point of contact is against the side of the yarns with the lowest coefficient of friction, in this case the second coating 9 since it has not been cured as much as the first coating 7. As a result, one side of the fabric, as it comes off the loom, predominates with the hue of the second coating. On the other side of the fabric, the second coating is less dominant, and under some circumstances, related to the degree of original color distinctions and the degree of eccentricity, the first coating hue may even dominate. There are other factors which can contribute to the frictional differences between the first and second coating, such as pigment characteristics and certain additives such as lubricants and anti-blocking agents which can be used in one coating but not the other. Although it is possible to adjust the formulations to minimize the color differential between the two fabric sides, it is frequently desirable to maintain a distinctive two-sided fabric for flexibility in end-use styling.

The expansible thread 1 of the present invention can also be used to make striped fabrics, as described in the Worrall application.

Above, a specific embodiment of the present invention has been described. It should be appreciated, however, that this embodiment was described for purposes of illustration only, and is in no way intended to limit the scope of the present invention. Rather, it is the intention that the present invention be limited only as defined in the appended claims.

What is claimed is:

1. An expansible thread, comprising a core yarn of a material selected from the group consisting of nylon, rayon, polyester, and glass, a first plastisol coating surrounding said core yarn, a second plastisol coating, of different color than said first plastisol coating, surrounding said first plastisol coating and eccentric thereto, said second plastisol coating having a melt viscosity sufficiently high so as to ensure that the second plastisol coating does not concentrically surround said first plastisol coating when said thread is fused by heat, said first and second plastisol coatings applied as a viscous liquid, said first and second plastisol coatings being less than fully cured but cured to the point where they can withstand the stresses of subsequent processing.

2. An expansible thread as claimed in claim 1 wherein said first and second plastisol coatings are vinyl coatings.

3. An expansible thread as claimed in claim 1 wherein said first and second plastisol coatings are latent foam vinyl coatings.

4. An expansible thread as claimed in claim 1 wherein said first plastisol coating has substantially more blowing agent than said second plastisol coating.

5. An expansible thread as claimed in claim 4 wherein said first plastisol coating has around 4% blowing agent and said second plastisol coating has no blowing agent.

6. An expansible thread as claimed in claim 1 wherein said melt viscosity of said second plastisol coating is greater than said melt viscosity of said first plastisol coating.

7. An expansible thread as claimed in claim 4 wherein said second plastisol coating has around 0.2 to 0.4% blowing agent.

8. An expansible thread as claimed in claim 1 wherein said core yarn is a multifilament core yarn.

9. An expansible thread as claimed in claim 8 wherein said multifilament core yarn is a zero-twist multifilament core yarn.

10. A method of producing an expansible thread comprising the steps of forming a first plastisol coating around a filament yarn by applying a first viscous liquid plastisol compound to said yarn to encapsulate said yarn, partially curing said first plastisol coating, forming a second plastisol coating of different color than said first plastisol coating around said first coating by applying a second viscous liquid plastisol compound to said first plastisol coating, eccentric with said first plastisol coating, and partially curing said said second plastisol coating, wherein said step of forming a second plastisol coating comprises drawing said yarn encapsulated in said first plastisol coating, after said second plastisol compound is applied thereon, though a sizing die wherein the longitudinal axis of said yarn is closer to one side of the sizing die than to the other side of the sizing die to form an eccentric second plastisol coating over said first plastisol coating, and wherein the room temperature viscosity of said second viscous liquid plastisol compound, when applied to said first partially cured first coating, is sufficiently high so that said second coating does not flow concentrically around said first coating, but sufficiently low so that the shear forces between the sizing die and the second plastisol coating do not cause the longitudinal axis of the thread to center itself between each side of the sizing die.

11. A method as claimed in claim 10 wherein said step of forming a first plastisol coating further comprises drawing said encapsulated yarn through a sizing die to bring the encapsulated first coating to a selected thickness before partially curing said first coating.

12. A method as claimed in claim 10 wherein said first viscous liquid plastisol compound contains substantially more blowing agent than said second viscous liquid plastisol compound.

13. A substantially planar fabric having a textured multicolor appearance comprising a plurality of woven threads, each thread comprising a multifilament core yarn, a first plastisol coating surrounding said core yarn, a second plastisol coating, having a different color than said first plastisol coating, around said first plastisol coating and eccentric therewith so as to form relatively thick and thin regions around the first plastisol coating, said first plastisol coating expanding through the thin regions of said second plastisol coating during heat activated foaming of said woven threads to form a textured, multicolor fabric.

14. A substantially planar fabric as claimed in claim 13 wherein the melt viscosity of said second plastisol coating at the foaming temperature is sufficiently high so as to ensure that the second plastisol coating does not concentrically surround said first plastisol coating during heat activated foaming.

15. A substantially planar fabric as claimed in claim 14 wherein the first plastisol coating includes a greater amount of blowing agent than said second plastisol coating to enable the first plastisol coating to expand during heat activated foaming a greater amount than the second plastisol coating.

16. A substantially planar fabric as claimed in claim 15 wherein said first plastisol coating has 4% blowing agent and said second plastisol coating has no blowing agent.

17. A substantially planar fabric as claimed in claim 15 wherein said first plastisol coating has 4% blowing agent and said second plastisol coating has 0.4% blowing agent.

18. A substantially planar fabric as claimed in claim 13 wherein said first and second plastisol coatings are applied to said yarn as viscous liquids.

19. A substantially planar fabric as claimed in claim 13 wherein said thread has additional plastisol coatings, each plastisol coating eccentric with respect to the prior coatings.

20. A substantially planar fabric as claimed in claim 13 wherein said multifilament core yarn has a zero twist.

21. A substantially planar fabric as claimed in claim 20 wherein the zero twist core yarn is substantially flattened during heat activated foaming.

22. A substantially planar fabric as claimed in claim 13 wherein said second plastisol coating is translucent.

23. A substantially planar fabric as claimed in claim 13 wherein one side of the fabric has the predominant color of said first plastisol coating and the other side of the fabric has the predominant color of said second plastisol coating.

24. A method of producing a substantially planar fabric having a textured, multicolor appearance, comprising producing an expansible thread by the steps of forming a first plastisol coating around a filament yarn by applying a first viscous liquid plastisol compound to said yarn to encapsulate said yarn, partially curing said first plastisol coating at a temperature below the foaming temperature, forming a second plastisol coating around said first coating by applying a second viscous liquid plastisol compound to said first plastisol coating, eccentric with said first plastisol coating, said second plastisol coating being a different color than said first plastisol coating, and partially curing said second plastisol coating at a temperature below the foaming temperature, weaving a plurality of said expansible threads into a fabric, and heating said fabric to a foaming temperature to permit the first plastisol coating to expand through the second plastisol coating at the thin regions of said second plastisol coating.

25. The method of claim 24 wherein the heating step is carried out in a tenter frame, while tension is applied to said fabric.

26. The method of claim 24 wherein the melt viscosity of said second plastisol coating at the foaming temperature is sufficiently high so as to ensure that the second plastisol coating does not concentrically surround said first plastisol coating during the heating step.

27. The method of claim 26 wherein the first plastisol coating includes a greater amount of blowing agent than said second plastisol coating to enable the first plastisol coating to expand during the heating step a greater amount than the second plastisol coating.

28. The method of claim 27 wherein said first plastisol coating has 4% blowing agent and said second plastisol coating has no blowing agent.

29. The method of claim 27 wherein said first plastisol coating has 4% blowing agent and said second plastisol coating has 0.4% blowing agent.

30. The method of claim 24 or 26 wherein said step of forming a second plastisol coating comprises drawing said thread, after said second plastisol compound is applied thereon, through a sizing die wherein the longitudinal axis of said thread is closer to one side of the sizing die than the other side of the sizing die to form an eccentric second plastisol coating over said first plastisol coating.

31. The method of claim 24 or 26 wherein the room temperature viscosity of said second viscous liquid plastisol compound, when applied to said first partially cured first coating, is sufficiently high so that said second coating does not flow concentrically around said first coating.

32. The method of claim 30 wherein the room temperature viscosity of said second viscous liquid plastisol compound, when drawn through said sizing die, is sufficiently low so that the shear forces between the sizing die and the second plastisol coating do not cause the longitudinal axis of the thread to center itself between each side of the sizing die.

33. A substantially planar fabric having a textured multicolor appearance made by the method as claimed in claim 24.

34. An expansible thread as claimed in claim 3 wherein said first and second coatings are partially cured to a level without activating any blowing agents in said first and second coatings.

35. A method as claimed in claim 12 wherein said steps of partially curing said first plastisol coating and partially curing said second plastisol coating comprises curing the respective coatings at a temperature below that at which said blowing agents in said first and second coatings are activated.

* * * * *